United States Patent [19]

Piber

[11] 4,190,750

[45] Feb. 26, 1980

[54] SNAP-ACTION SWITCH OF THE ROLLER CONTACT TYPE

[75] Inventor: Earl T. Piber, Oconomowoc, Wis.

[73] Assignee: Eaton Corporation, Cleveland, Ohio

[21] Appl. No.: 905,286

[22] Filed: May 11, 1978

[51] Int. Cl.[2] ..... H01H 21/04; H01H 15/18; H01H 1/16

[52] U.S. Cl. ..... 200/67 AA; 200/67 G; 200/77; 200/153 LA; 200/277

[58] Field of Search ..... 200/67 AA, 67 G, 67 A, 200/76, 68, 277, 77, 250, 243, 153 LA

[56] References Cited

U.S. PATENT DOCUMENTS

| | | | |
|---|---|---|---|
| 1,882,857 | 10/1932 | Meuer | 200/67 AA |
| 1,919,119 | 7/1933 | Nero | 200/67 AA |
| 2,633,510 | 3/1953 | Schellman | 200/68 |
| 2,945,098 | 7/1960 | Ludwig | 200/51 R |
| 3,598,943 | 8/1971 | Barrett | 200/67 G |
| 3,600,533 | 8/1971 | English | 200/77 |
| 3,681,547 | 8/1972 | Burch et al. | 200/68 |
| 3,792,212 | 2/1974 | Ludwig | 200/67 AA |
| 3,869,590 | 3/1975 | Hults | 200/157 |
| 3,872,269 | 3/1975 | Schneider | 200/67 AA |
| 3,971,905 | 7/1976 | Delaage | 200/67 AA |
| 4,081,641 | 3/1978 | Piber | 200/277 |

*Primary Examiner*—Steven L. Stephan

*Attorney, Agent, or Firm*—Hugh R. Rather; William A. Autio

[57] ABSTRACT

A single-pole single-throw electric switch having a fewer number of simple parts more easily adapted for automatic assembly, and having a low base height due to a leaf spring biased roller contact actuated by a double-incline apex on the operating lever movable over-center on the roller contact to snap it into or out of bridging engagement with a pair of stationary contacts. A single insulating plate held in vertical grooves in opposite walls of an open-top base retains in place a pair of press-in lead leaf-spring connectors and also supports the stationary contacts in place up against the cover, the terminal portions of which are retained by their opposite edges in spaced vertical grooves in opposite walls of a pair of terminal compartments in the base. The arrangement is such that all the parts can be lowered down into the base in predetermined order thereby affording automatic assembly. The switch is operable by any one of a number of different types of operating levers such as a toggle lever, a trigger, a slide button, a push-push button, or the like, provided the cover is suitably configured to accommodate the desired operating lever, and is adapted for use with any one of a number of different types of connectors such as push-in lead, screw terminal or solder lug.

16 Claims, 7 Drawing Figures

Fig. 5
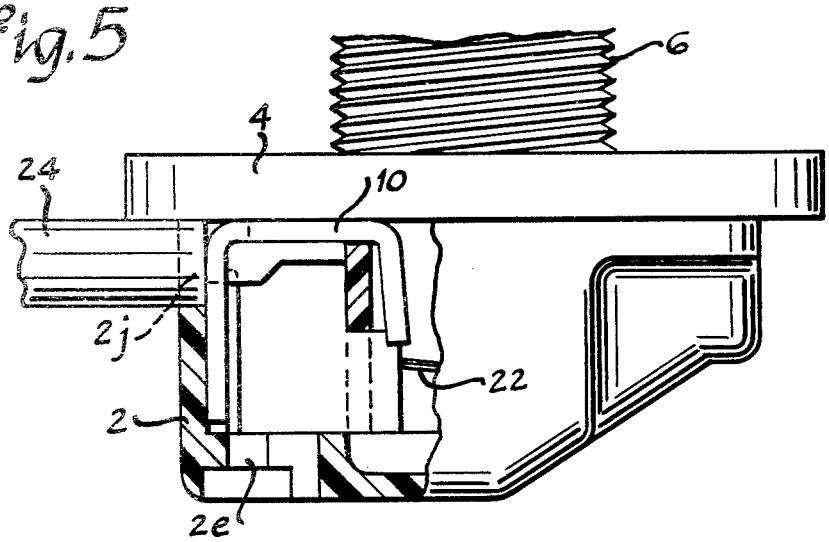
Fig. 7
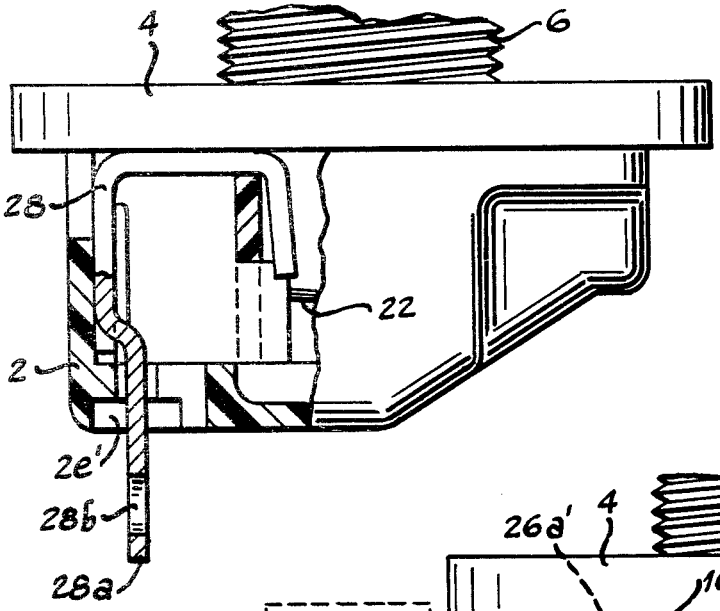
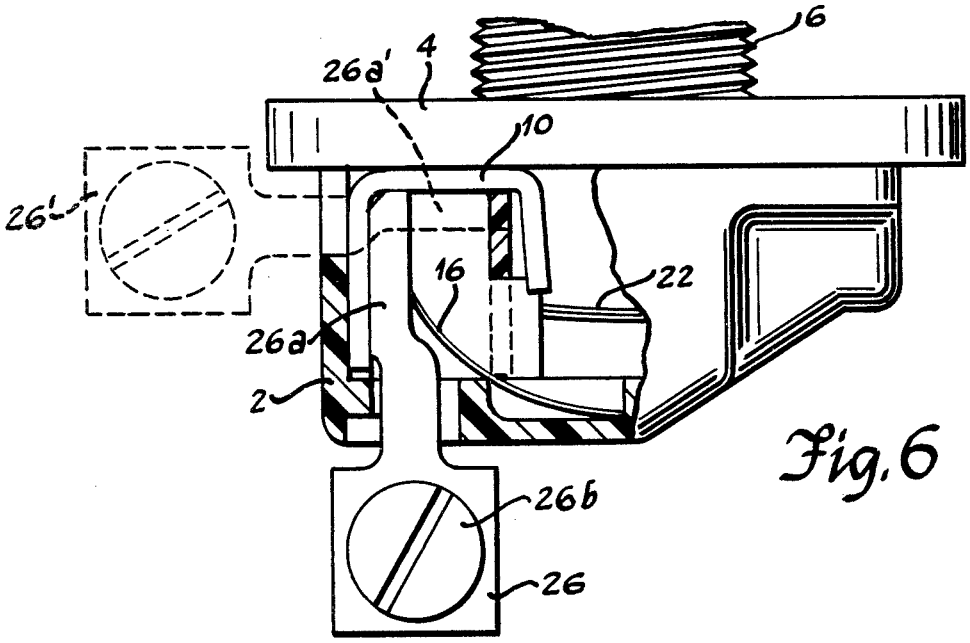
Fig. 6

SNAP-ACTION SWITCH OF THE ROLLER CONTACT TYPE

BACKGROUND OF THE INVENTION

Switches of the type wherein relative motion between a sliding or rolling member and the high point or apex of a double-incline cam is used to attain snap-action contact operation have been known heretofore. But switches of that type have had disadvantages in that they have been rather complicated in construction with a large member of parts that were comparatively difficult to assemble thereby keeping the costs of manufacture rather high. Thus, it has been found desirable to provide a switch that overcomes these disadvantages.

SUMMARY OF THE INVENTION

An object of the invention is to provide an improved electric switch.

Another object of the invention is to provide an improved electric switch of the snap-action type having a fewer number of parts.

Another object of the invention is to provide an improved snap-action electric switch having fewer parts of simpler construction providing a low base height.

Another object of the invention is to provide an improved electric switch of simple construction that is adapted for use with any one of a variety of different actuators.

Another object of the invention is to provide an improved electric switch of simple construction that is readily adaptable to automated assembly.

Other objects and advantages of the invention will hereinafter appear.

BRIEF DESCRIPTION OF THE DRAWINGS

FIG. 5 is a fragmentary side elevational view, partly in section, of the switch of FIGS. 1–4 showing an alternative connector means for connecting the stationary contacts through short wires to an external circuit;

FIG. 6 is a view like FIG. 5 showing another alternative connector means affording bottom or end screw terminals for connecting the stationary contacts to an external circuit; and FIG. 7 is a view like FIG. 5 showing a further alternative connector means attained by substituting different stationary contacts to afford solder lugs for connecting the stationary contacts to an external circuit.

DESCRIPTION OF THE PREFERRED EMBODIMENTS

Figure 1:
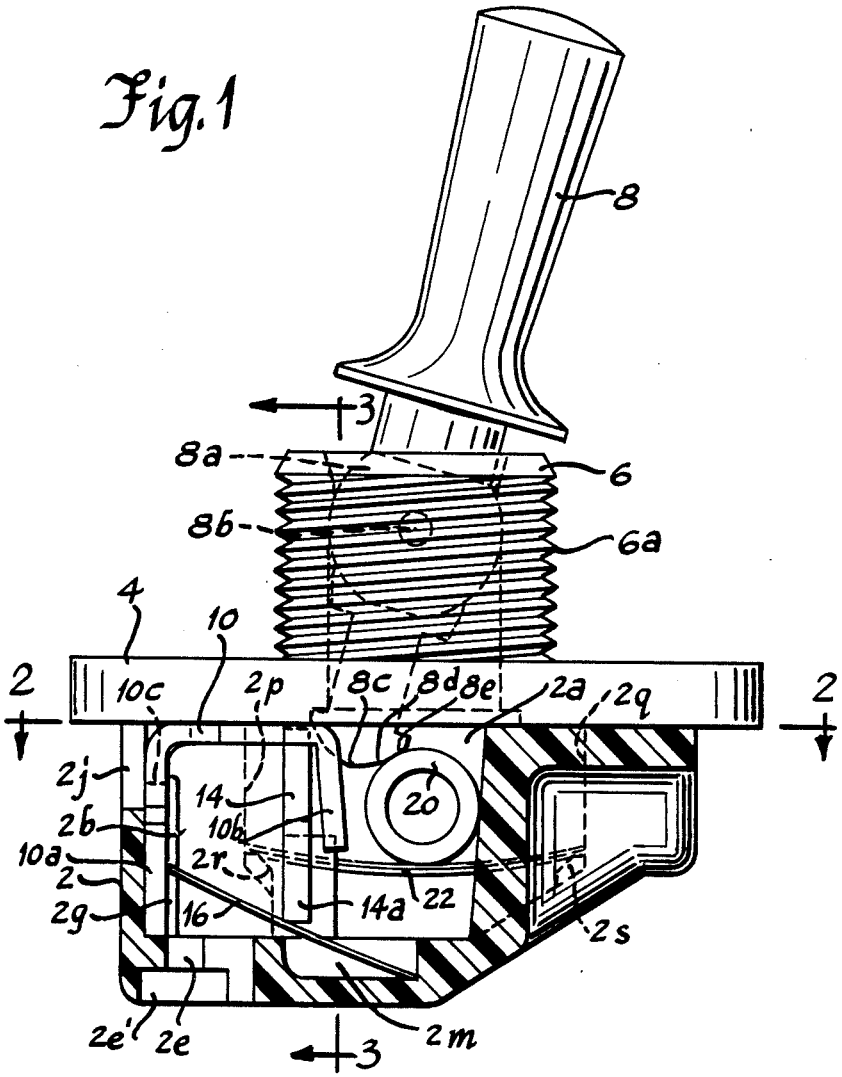
FIG. 1 is an enlarged side view, partly in section, of a snap-action switch of the roller contact type taken substantially along line 1—1 of FIG. 3 to show the contact arrangement and leaf spring within the base.
Figure 2:
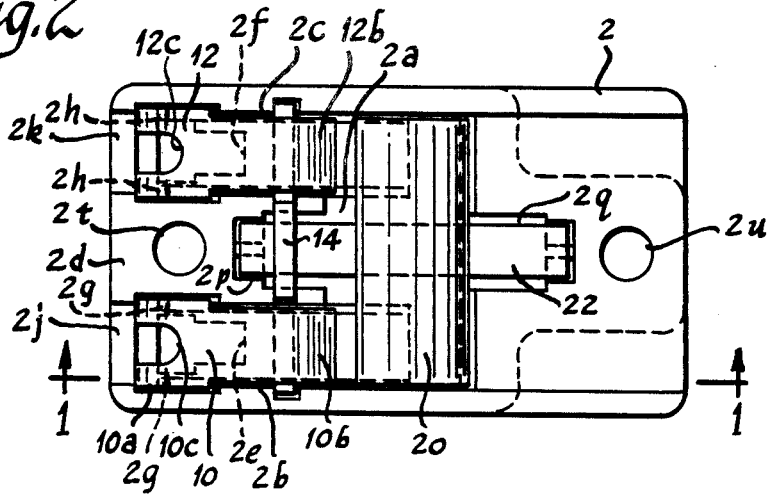
FIG. 2 is a horizontal cross-sectional view taken substantially along line 2—2 of FIG. 1 to show a top view of the bridging contacts.
Figure 3:
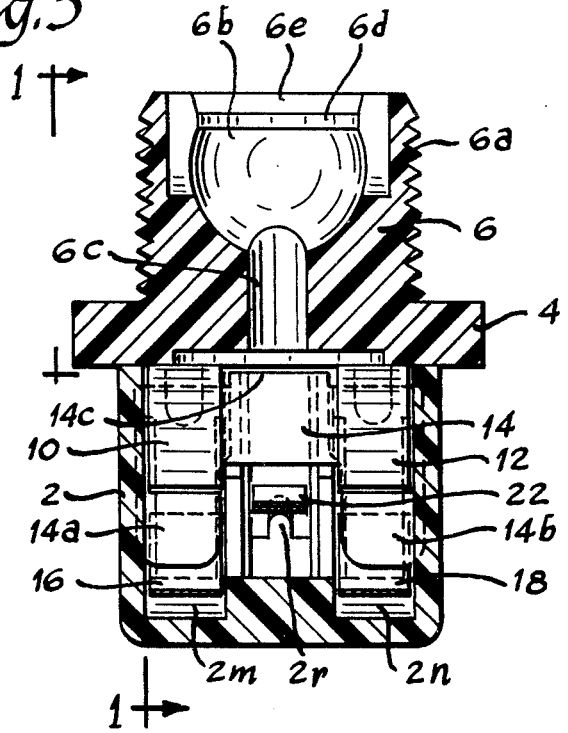
FIG. 3 is a vertical cross-sectional view taken substantially along line 3—3 of FIG. 1 to show the insulating retainer plate.

Referring to FIGS. 1–3, there is shown a snap-action switch of the roller contact type constructed in accordance with the invention. As shown therein, this switch is provided with a housing including an insulating, molded plastic, open-top base 2 and an insulating, molded plastic cover 4 closing the top of the base and having an integral upstanding bushing 6 thereon. An actuator in the form of a toggle lever 8 is snap-in mounted in the bushing for limited pivotal movement to operate the contacts as hereinafter described.

Base 2 is provided with a switch compartment including a contact compartment **2*a* substantially centrally thereof and two connector compartments 2*b* and 2*c* at its left-hand end separated by a wall 2*d* as shown in FIGS. 1 and 2. Two generally T-shaped apertures or holes 2*e* and 2*f* in the bottom of the left-hand end of the base, as shown in FIGS. 1 and 2, provide access for inserting electrical conductors into connector compartments 2*b* and 2*c*, respectively. As shown in FIG. 1, the bottom of the base is provided with generally rectangular recesses such as 2*e'*** around the largest portion of these holes to provide clearance for the insulation of the conductor that is inserted therethrough.

Vertically extending ridges **2*g* in opposite side walls of connector compartment 2*b* provide vertical grooves between these ridges and the left end wall of the base for retaining terminal portion 10*a* of one stationary contact 10 as shown in FIGS. 1 and 2. Similar vertically extending ridges 2*h* in opposite side walls of connector compartment 2*c* provide vertical grooves between these ridges and the left end wall of the base for retaining the opposite edges of terminal portion 12*a* of a second stationary contact 12 as shown in FIGS. 1 and 2. As shown in FIG. 1, each stationary contact is a flat strip element having two bends to provide a vertical terminal portion such as 10*a*, a horizontal intermediate portion and a downwardly angled contact portion such as 10*b*. These stationary contacts are also provided with generally oblong holes 10*c* and 12*c* at the bend between their terminal and intermediate portions as shown in FIG. 2 for entry of alternative connector means hereinafter described in connection with FIGS. 5 and 6. For this purpose, the base is provided with a pair of rectangular apertures or holes 2*j* and 2*k* in registration with the respective holes in the stationary contacts for entry of such connector means. These holes 2*j* and 2*k*** are in the form of slots extending down from the upper edge of the left end wall of the base.

These stationary contacts 10 and 12 extend upwardly along the left end wall of the base as shown in FIG. 1, with their edges held in the aforesaid grooves as shown in broken lines in FIG. 2, up to the top of the base and then toward the right along the lower surface of cover 4 into contact compartment **2*a*, and then downwardly along the left side of contact compartment 2*a* with a small rightward angle as shown in FIG. 1 to provide stationary contact portions 10*b* and 12*b*** within the left side of the contact compartment.

Means is provided to retain the contact portions **10*b* and 12*b* of these stationary contacts in place within the base. This means comprises a generally inverted U-shaped insulating retainer plate 14 of fibre board or the like held by its side edges in a pair of vertical grooves in the side walls of the base as shown in FIGS. 1, 2 and 3. Legs 14*a* and 14*b* of this retainer plate press down on wire clamps 16 and 18, respectively, to hold them in place with their left ends pressed against terminal portions 10*a* and 12*a* of the stationary contacts as shown in FIGS. 1 through 3**.

As shown in FIG. 1, wire clamp 16 is a rectangular piece of steel sheet having one end held in a corner of recess 2*m* in the bottom of the base below the contact compartment and it inclines or extends leftward at an upward angle therefrom past the end of leg 14*a* of the retainer plate and has its other end pressed against terminal portion 10*a*. Wire clamp 18 is similarly trapped at one end in a similar recess 2*n*, FIG. 3, at the other side of the bottom of the base and extends leftward at an upward angle so that its other end is pressed against terminal portion 12*a*. In this manner, stiff bare conductors inserted up through the cross portions of T-shaped holes 2*e* and 2*f* are slid between each wire clamp and the associated terminal portion to make an electrical connection to an external circuit. The leg portions of these T-shaped holes provide clearance for a probe to release these wire clamps.

Retainer plate 14 has a central lug 14*c* on its upper edge as shown in FIG. 3 that is shorter vertically than the thickness of stationary contacts 10 and 12 so as to retain these contact-terminals suitably spaced apart and up against the lower surface of cover 4. The spring force from wire clamps 16 and 18 upwardly onto legs 14*a* and 14*b* resiliently holds the retainer plate pressed up against the stationary contacts.

A movable contact 20 is supported in the contact compartment by a leaf spring 22. This movable contact is of the elongated rotary or roller contact type having a cylindrical form and flat ends such as a piece of copper tube extending between and guided by the flat side walls of the base as shown in FIGS. 1 and 2. Spring 22 comprises two stacked rectangular strips of stainless steel or the like supported at its ends in the base. For this purpose, the left and right end walls of the contact compartments are provided with recesses or slots 2*p* and 2*q*, recess 2*p* being in dividing wall 2*d*.

The bottoms of these recesses are provided with round-top ridges 2*r* and 4*s*, respectively, inclined toward the bottom of the contact compartment for supporting the opposite ends of spring 22. Also the bottoms of these recesses and the ridges thereon are spaced equally above the bottom of the contact compartment to allow the center of the spring to dip down when the switch is actuated. Recesses 2*p* and 2*q* are open to the top of the base to allow dropping of spring 22 into place.

In order to secure the cover to the base, the base is provided with two blind holes 2*t* and 2*u* extending partway down from the top. As shown in FIG. 2, hole 2*t* extends down into dividing wall 2*d* and hole 2*u* extends down into the solid portion between recess 2*q* and the right-hand end of the base. The cover is secured to the base by two drive screws inserted through holes in the cover and driven into these holes 2*t* and 2*u* in the base.

Figure 4:
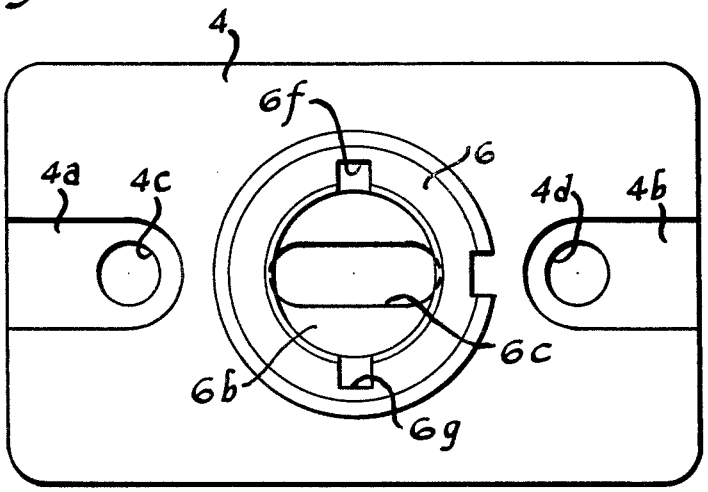
FIG. 4 is a top view of the cover of the switch of FIG. 1 showing the bushing bore configuration into which the toggle lever is snap-in assembled.

As shown in FIG. 4, cover 4 is provided with two recesses 4*a* and 4*b* in its upper surface and holes 4*c* and 4*d* extending from the respective recesses through the cover in alignment with blind holes 2*t* and 2*u* in the base. Recesses 4*a* and 4*b* provide clearance for the drive screw heads so that the cover can be placed flat against a mounting panel when the switch is installed.

Bushing 6 which is molded integrally with the cover is provided with an external thread 6*a* onto which a mounting nut may be threaded after the bushing has been inserted through a hole in a mounting panel to secure the switch to the panel. This bushing is also provided with means for snap-in mounting a toggle lever 8. For this purpose, the bushing is provided with a socket 6*b* at its upper portion and a flat or oblong hole 6*c* extending from this socket down through the bushing and cover as shown in FIGS. 3 and 4. As shown in FIG. 3, this socket is partial-spherical and has a constriction 6*d* adjacent the top of the bushing past which spherical intermediate portion 8*a* of the toggle lever must be pressed to enter the socket with the round handle portion remaining on the outside above the bushing. The bushing is of plastic material and sufficiently resilient to allow the toggle lever ball to be snapped past this interfering constriction into the socket. A bevel 6*e* at the mouth of the socket facilitates guiding the toggle lever ball into the socket.

A pair of lateral, vertical grooves 6*f* and 6*g* extend down along opposite sides of socket 6*b* as shown in FIGS. 3 and 4 for receiving integrally molded short trunnions 8*b* on opposite sides of spherical portion 8*a* of the toggle lever. As shown in FIG. 4, these grooves 6*f* and 6*g* are on a line perpendicular to the long dimension of flat hole 6*c* so that the toggle lever trunnions will be journaled at the lower ends of these grooves to keep the toggle lever from rotating on its longitudinal axis while the flat lower end portion of the toggle lever swings in correspondingly flat hole 6*c*. The toggle lever pivots in the socket as well as on trunnions 8*b* shown in dotted lines in FIG. 1.

To close the switch, the toggle lever is pivoted counterclockwise from the position shown in FIG. 1. As a result, apex 8*c* at the lower end of the toggle lever slides over roller contact 20, depressing this roller contact and stressing spring 22. As soon as the apex of the toggle lever has passed over the high point on the upper curvature or convex surface of roller contact 20, the roller contact snaps toward the left under the reactive force of spring 22 into bridging engagement with stationary contacts 10*b* and 12*b*.

The lower end of the toggle lever is provided with two pairs of angular surfaces. The first pair of these angular surfaces 8*d* join to form the apex 8*c* and have small relative angles such as to ease the movement of the toggle lever apex over the movable roller contact. The other angular surfaces 8*e* on opposite sides of the first pair have steeper relative angles such as to provide the movable contact with the required contact pressure against the stationary contacts when the contacts are closed. As will be apparent, the toggle lever is symmetrical so that it can be inserted in the socket as shown in FIG. 1 or 180 degress turned from that position.

It will be apparent that the switch can be adapted to automated assembly. For this purpose, wire clamps 16 and 18 are first dropped down into the switch compartment with their right hand ends in recesses 2*m* and 2*n*. Next, probes are inserted through holes 2*e* and 2*f* to hold the other ends of these wire clamps out of the way for insertion of the stationary contacts which are not inserted yet. Then, the two stacked strips constituting leaf spring 22 are dropped into the switch compartment with their ends in slots 2*p* and 2*q*. Or, of course, these strips can be dropped in before the aforesaid probes are inserted. Then, retainer plate 14 is dropped or inserted into the base with its edges sliding down grooves in the walls of the base shown in FIG. 2. Next, the two stationary contacts are dropped or inserted into the switch compartment with their terminal portions sliding down the pairs of grooves in the walls of the connector compartments. Then, movable contact 20 is dropped into the contact compartment, coming to rest on spring 22. Then, the toggle lever is snapped into the bushing and the cover is placed over the base and the two drive screws are inserted through the holes in the cover and driven into the blind holes in the base to complete assembly of the switch.

The alternative connector means shown in FIG. 5 uses short conductors rather than the wire clamps of FIG. 1. A pair of short conductors such as 24 in FIG. 5 have the insulation stripped from both ends and first ends thereof are inserted through holes 10*c* and 12*c* in the stationary contacts and secured by soldering or welding to the lower surfaces of the horizontal intermediate portions of the stationary contacts. This is done beforehand so that when the stationary contacts are assembled into the base, slots 2*j* and 2*k* provide clearance for these conductors as shown in FIG. 5. Also, wire clamps 16 and 18 may be omitted in FIG. 5. The other ends of these conductors such as 24 may then be connected by speed nuts to an external circuit.

FIG. 6 shows another alternative connector means providing screw terminals at the bottom of the base and a variation thereof in broken lines providing the screw terminals alternatively at the end of the base. The switch structure in FIG. 6 is like that in FIGS. 1–4 with the addition that the narrow stems such as 26*a* of a pair of screw terminals such as 26 are inserted up through bottom holes 2*e* and 2*f* of the base to be gripped between the wire clamps and the terminal portions of the stationary contacts. Screws such as 26*b* may then be used to connect the stationary contacts to an external circuit. These wire clamps will grip these screw terminals in a similar manner as they would grip stripped ends of insulated wires in FIGS. 1–4.

If it is desired to have these screw terminals at the end of the base rather than at the bottom due to space limitations adjacent the bottom of the switch within the tool or appliance into which it is mounted, this can be readily done as shown in broken lines in FIG. 6. For this purpose, the stems 26*a*′ of screw terminals 26′ are secured to the stationary contacts before assembly in the manner of wires 24 in FIG. 5.

FIG. 7 shows a further alternative connector means providing solder lugs at the bottom of the base. For this purpose, modified stationary contacts such as 28 are used. These modified stationary contacts are like those in FIGS. 1–6 except that their terminal portions are provided with integral, narrower, offset extensions 28*a* having oblong holes 28*b* therein as indicated in FIG. 4 providing solder lugs. These extensions are long enough to extend out through the bottom holes 2*e* and 2*f* of the base and are offset so that they will line up with the holes in the bottom of the base as shown in FIG. 7. The stripped ends of wires may be inserted through holes 28*b*, bent around these extensions and soldered thereto to connect the stationary contacts to an external circuit.

It will be apparent from the foregoing description of the alternative connector means that these can be provided for with minimum addition or substitution of parts and requires no modification of the base.

While a toggle lever has been shown as an actuator in FIG. 1, it will be apparent that other actuators such as a slide button, a rocker button or a slidable trigger could also be used in place thereof by substituting a cover suitably modified to provide for mounting and movement thereof. A push-push actuator could also be used such as the actuator shown in A. W. Krieger U.S. Pat. No. 2,295,484, dated Sept. 8, 1942, provided actuating element 19 thereof were given the double-incline apex form used in the present toggle lever.

While the apparatus hereinabove described is effectively adapted to fulfill the objects stated, it is to be understood that the invention is not intended to be confined to the particular preferred embodiments of snap-action switch of the roller contact type disclosed, inasmuch as they are susceptible of various modifications without departing from the scope of the appended claims.

I claim:

1. A snap-action electric switch comprising:

an insulating housing having an open-top base closed by a cover providing a switch compartment with parallel side walls therein;

a pair of stationary contacts;

means for receiving said stationary contacts vertically down into said base for mounting in laterally spaced apart relation in said switch compartment;

a single-piece laterally-arranged elongated movable contact having ends complementary to said parallel side walls of said switch compartment whereby it is received vertically down into said base and guided for bridging said stationary contacts and having a curved surface whereby it is actuated;

an elongated leaf spring;

and means in said base for receiving said leaf spring vertically down thereinto to be supported at its ends above the bottom of said switch compartment for supporting and biasing said movable contact for movement into and out of bridging engagement with said stationary contacts;

actuator means movably mounted on said cover of said housing and comprising a double-incline apex movable over said curved surface of said movable contact while depressing said movable contact down against the force of said leaf spring to cause downward flexure of the latter to effect snap-action closure or opening of said movable contact with respect to said stationary contacts;

apertures in said housing located with respect to said stationary contacts;

and connector means accommodated by said apertures for connecting said stationary contacts to an external circuit.

2. The snap-action electric switch claimed in claim 1, wherein:

said parallel side walls are flat;

and said elongated movable contact is a cylindrical member having planar ends guided by said flat parallel side walls and uniform cross-section throughout its length.

3. The snap-action electric switch claimed in claim 1, wherein:

said parallel side walls are flat;

and said elongated movable contact is a round tubular member having planar parallel ends guided by said flat parallel side walls.

4. The snap-action electric switch claimed in claim 1, wherein:

said pair of said stationary contacts comprise:

a pair of flat strip members having two spaced bends to form a vertical terminal leg portion at one end and a downwardly angled contact leg portion at the other end;

and said means for receiving said stationary contacts vertically down into said base comprises vertical grooves in said base retaining the terminal leg portions of said stationary contacts so as to position said contact leg portions with respect to said movable contact.

5. The snap-action electric switch claimed in claim 4, wherein said connector means comprises:

a pair of straight elongated wire clamps and recesses in the bottom of said base for receiving said clamps vertically down thereinto to trap first ends thereof and being inclined therefrom with their other ends against the respective terminal leg portions of said stationary contacts;

and means held by said stationary contacts for biasing said other ends of said wire clamps against the respective terminal leg portions of said stationary contacts so that a pair of conductors may be inserted through a pair of said apertures in said housing in between said terminal leg portions and said wire clamps, respectively, to make an electric connection to said switch.

6. The snap-action electric switch claimed in claim 5, wherein:

said means biasing said other ends of said wire clamps comprises an insulating plate;

and means in said base for receiving said insulating plate vertically down thereinto to be confined between said stationary contacts and said wire clamps to bias the latter against the respective terminal leg portions of said stationary contacts.

7. A snap-action electric switch comprising:

an insulating housing having a switch compartment therein including a contact compartment and a pair of laterally spaced part connector compartments separated by a dividing wall and having opposed vertical grooves in their side walls;

a pair of generally inverted J-shaped stationary contacts formed from flat strip material mounted in said switch compartment with at least part of the shank portions thereof being retained by their edges in said opposed vertical grooves in the respective connector compartments and the intermediate portions thereof extending horizontally with the downwardly formed tip portions thereof being situate in said contact compartment;

a laterally arranged elongated rotary movable contact extending between the side walls of said contact compartment and being movable to bridge said stationary contacts and having a convex surface whereby it is actuated;

a leaf spring supported above the bottom of said contact compartment and supported and biasing said movable contact for movement into and out of engagement with said stationary contacts;

actuator means movably mounted on said housing and comprising a double-incline apex movable over said convex surface of said movable contact while depressing said movable contact against the force of said leaf spring to cause downward flexure of the latter and consequent upward reactive force to effect snap-action closure or opening of said movable contact with respect to said stationary contacts;

apertures in said housing located with respect to said stationary contacts;

and connector means accommodated by said apertures for connecting said stationary contacts to an external circuit.

8. The snap-action electric switch claimed in claim 7, wherein said connector means comprise:

a pair of wire clamp strips having first ends retained in recesses in the bottom of said switch compartment and inclined therefrom with their other ends against the shank portions of the respective stationary contacts above a pair of said apertures;

and an insulating member in said housing pressing on the intermediate portions of said wire clamp strips whereby electric conductors inserted up through said pair of apertures will be clamped by said wire clamp strips against said shank portions of the respective stationary contacts.

9. The snap-action electric switch claimed in claim 8, wherein:

said insulating member is confined between said wire clamp strips and said intermediate horizontal portions of said stationary contacts adjacent their down-formed tip portions to support the latter in addition to biasing said wire clamp strips.

10. The snap-action electric switch claimed in claim 8, wherein said connector means comprise:

a pair of wire clamp strips having first ends retained in recesses in the bottom of said switch compartment and inclined therefrom with their other ends against the shank portions of the respective stationary contacts above a pair of said apertures;

an insulating member in said housing pressing on the intermediate portions of said wire clamp strips to bias their other ends against said shank portions;

and screw terminals have narrow portions extending up through said pair of apertures and held by said wire clamp strips against said shank portions of said stationary contacts.

11. The snap-action electric switch claimed in claim 7, wherein said connector means comprises:

holes at the bends between the vertical shank portions and the horizontally disposed intermediate portions of said stationary contacts registering with a pair of said apertures in said housing and conductors extending therethrough and electrically connected to the lower surfaces of said intermediate portions of said stationary contacts.

12. The snap-action electric switch claimed in claim 11, wherein said conductors comprise:

screw terminals having narrow portions extending through said apertures and holes and electrically connected to said lower surfaces of said intermediate portions of said stationary contacts.

13. The snap-action electric switch claimed in claim 7, wherein said connector means comprises:

extensions on the shank portions of said stationary contacts extending out through a pair of said apertures and having means thereon to serve as solder lugs for external conductors.

14. The snap-action electric switch claimed in claim 7, wherein:

said housing comprises a pair of recesses with ridges therein for supporting the opposite ends of said leaf spring, one of said recesses being in the end of said dividing wall that separates said connector compartments and the other recess being in the wall of said contact compartment directly across from said first recess so that said leaf spring extends across said contact compartment.

15. A snap-action electric switch comprising:

an insulating housing having an open-top switch compartment therein;

a pair of stationary contacts;

means mounting said stationary contacts in laterally spaced part relation in said switch compartment;

each said stationary contact comprising a generally flat strip having two bends to provide a vertical mounting leg portion held in slots in said housing and an intermediate portion extending horizontally along the top of said contact compartment and a downwardly angled portion providing stationary contacts in said switch compartment;

a laterally arranged elongated rotary movable contact guided at its ends between the side walls of said switch compartment for bridging said stationary contacts and having a circular surface for engagement by an actuator;

a leaf spring supporting and biasing said movable contact for movement from an open position against an abutment in said housing forwardly to a closed position against said stationary contacts;

horizontally spaced means supporting said leaf spring at its ends above the bottom of said switch compartment so that its intermediate portion supports said movable contact and flexes downwardly when said movable contact is depressed by an actuator;

a cover closing said open-top housing;

an actuator movably supported on said cover and comprising a double-incline apex movable over said circular surface of said movable contact while depressing the latter against the force of said leaf spring to cause flexure of the latter and effect snap-action closure or opening of said movable contact with respect to said pair of contacts;

and connector means for connecting said stationary contacts to an external circuit.

16. The snap-action electric switch claimed in claim 15, wherein said connector means comprises:

a pair of wire clamp strips having first ends lodged in recesses in the bottom of said switch compartment and inclined therefrom so that their other ends lean against said vertical mounting leg portions of said stationary contacts;

and an insulating member retained in said housing so as to press down on midportions of said wire clamp strips as well as to support the intermediate horizontal portions of said stationary contacts up against said cover.

* * * * *